US010766064B2

(12) United States Patent
Erhard et al.

(10) Patent No.: US 10,766,064 B2
(45) Date of Patent: Sep. 8, 2020

(54) CASTING COMPONENT AND METHOD FOR THE APPLICATION OF AN ANTICORROSIVE LAYER

(75) Inventors: Norbert Erhard, Lorch (DE); Helmar Dannenmann, Schorndorf (DE); Juergen Kurz, Pluederhausen (DE); Andreas Sydlo, Urbach (DE); Daniel Gerner, Moegglingen (DE)

(73) Assignee: Oskar Frech GmbH + Co. KG, Schorndorf (DE)

( * ) Notice: Subject to any disclaimer, the term of this patent is extended or adjusted under 35 U.S.C. 154(b) by 1100 days.

(21) Appl. No.: 14/128,939

(22) PCT Filed: Jun. 22, 2012

(86) PCT No.: PCT/EP2012/062082
§ 371 (c)(1),
(2), (4) Date: Mar. 21, 2014

(87) PCT Pub. No.: WO2012/175668
PCT Pub. Date: Dec. 27, 2012

(65) Prior Publication Data

US 2014/0193635 A1 Jul. 10, 2014

(30) Foreign Application Priority Data

Jun. 24, 2011 (DE) ..... 10 2011 078 066

(51) Int. Cl.
*C23C 18/12* (2006.01)
*B22C 9/08* (2006.01)
(Continued)

(52) U.S. Cl.
CPC ..... *B22C 9/08* (2013.01); *B22D 17/2015* (2013.01); *C23C 18/122* (2013.01);
(Continued)

(58) Field of Classification Search
None
See application file for complete search history.

(56) References Cited

U.S. PATENT DOCUMENTS 4,029,000 A 6/1977 Nakamura et al.
4,556,098 A 12/1985 Hintermann et al.
(Continued)

FOREIGN PATENT DOCUMENTS

DE 2 364 809 8/1974
DE 35 13 882 A1 10/1986
(Continued)

OTHER PUBLICATIONS

International Search Report including English translation dated Jan. 31, 2014 (Seven (7) pages).
(Continued)

*Primary Examiner* — Callie E Shosho
*Assistant Examiner* — Daniel D Lowrey
(74) *Attorney, Agent, or Firm* — Crowell & Moring LLP

(57) ABSTRACT

A casting component and method for the application of an anticorrosive layer to a substrate, such as the casting component, are provided. The casting component for a device for casting a metal melt includes a metallic basic body and a melt contact surface region which is exposed to the metal melt during casting operation. In the casting component, the metallic basic body is provided in the melt contact surface region with an anticorrosive layer which is resistant to the metal melt and which is formed, using microparticles and/or nanoparticles of one or more substances from a substance group which includes borides, nitrides and carbides of the transition metals and their alloys and also of boron and silicon and $Al_2O_3$.

20 Claims, 2 Drawing Sheets

(51) Int. Cl.

| | |
|---|---|
| ***C23C 28/04*** | (2006.01) |
| ***C23C 30/00*** | (2006.01) |
| ***B22D 17/20*** | (2006.01) |
| ***F27D 15/00*** | (2006.01) |

(52) U.S. Cl.
CPC ..... *C23C 18/127* (2013.01); *C23C 18/1216* (2013.01); *C23C 18/1225* (2013.01); *C23C 18/1241* (2013.01); *C23C 18/1254* (2013.01); *C23C 28/04* (2013.01); *C23C 30/00* (2013.01); *F27D 15/00* (2013.01); *Y10T 428/256* (2015.01)

(56) References Cited

U.S. PATENT DOCUMENTS

| | | | | |
|---|---|---|---|---|
| 4,595,545 | A | 6/1986 | Sane | |
| 4,808,487 | A | 2/1989 | Gruenr | |
| 4,921,731 | A * | 5/1990 | Clark | C03C 17/23 427/314 |
| 5,053,251 | A | 10/1991 | Hara et al. | |
| 5,415,219 | A | 5/1995 | Wiedenmann et al. | |
| 6,284,682 | B1 * | 9/2001 | Troczynski | C04B 35/62222 501/111 |
| 8,012,252 | B2 | 9/2011 | Engler et al. | |
| 8,231,705 | B2 | 7/2012 | Uibel | |
| 8,900,694 | B2 | 12/2014 | Feber et al. | |
| 2004/0208986 | A1 * | 10/2004 | Flint | G01N 17/006 427/8 |
| 2004/0249039 | A1 | 12/2004 | Lamaze et al. | |
| 2006/0213634 | A1 | 9/2006 | Kaba et al. | |
| 2007/0054057 | A1 | 3/2007 | Matje et al. | |
| 2009/0119882 | A1 * | 5/2009 | Uibel | B22D 41/02 23/295 R |
| 2009/0236780 | A1 * | 9/2009 | Engler | C23C 26/00 266/200 |
| 2010/0178491 | A1 | 7/2010 | Mennig et al. | |
| 2010/0178941 | A1 | 7/2010 | Menning et al. | |

FOREIGN PATENT DOCUMENTS

| | | | |
|---|---|---|---|
| DE | 103 26 769 | B3 | 11/2004 |
| DE | 10 2006 040 385 | A1 | 1/2007 |
| DE | 10 2007 029 668 | A1 | 1/2009 |
| DE | 10 2007 053 284 | A1 | 5/2009 |
| JP | 57-71870 | A | 5/1982 |
| JP | 59-137309 | A | 8/1984 |
| JP | 2006-527090 | A | 11/2006 |
| JP | 2007-146132 | A | 6/2007 |
| JP | 2009-507972 | A | 2/2009 |
| JP | 2011-507981 | A | 3/2011 |
| WO | WO 2004/087351 | A1 | 10/2004 |

OTHER PUBLICATIONS

German language Written Opinion dated Jan. 31, 2014 (Six (6) pages).

Gebauer-Teichmann et al., "Multifunktionale Duplex-PACVD-Schicht-systeme im Aluminiumdruckguss," Vakuum in Forschung und Praxis, 2005, pp. 262-265, vol. 17, No. 5.

U.C. Nwaogu et al., "New sol-gel refractory coatings on chemically-bonded sand cores for foundry applications to improve casting surface quality," Surface & Coatings Technology 205 (2011), pp. 4035-4404.

* cited by examiner

CASTING COMPONENT AND METHOD FOR THE APPLICATION OF AN ANTICORROSIVE LAYER

BACKGROUND AND SUMMARY OF THE INVENTION

The invention relates to a casting component for a device for casting or handling a metal melt, the component having a metallic basic body and a surface region which is exposed to the metal melt during casting operation, and to a method for the application of an anticorrosive layer to a substrate, which may be, in particular, the casting component.

Casting components of this type are used in metal casting technology in many different forms, for example as casting fittings, casting vessels, melt furnaces, melt conveyor units and casting molds and also parts of these metal casting constituents. A steel material is mostly used for the basic body, since components of this type possess a good cost/benefit ratio.

It became clear, however, that casting components made from steel, in regions where they come into contact with the hot metal melt during casting operation, are attacked chemically by the liquid metal melt, that is to say are subject to corrosion. Thus, for example, it is observed, in aluminum diecasting, that aluminum melts noticeably attack corrosively those steel surfaces of casting components which come into contact with these melts. To remedy this, it is known, for casting piston/casting cylinder units of metal diecasting machines, to manufacture the casting piston and the casting cylinder entirely from a ceramic material or from a sintered material, for example from sintered titanium diboride ($TiB_2$). However, mechanical strength, heat resistance and shock resistance have still been unsatisfactory. It is proposed as a remedy, in laid-open publication DE 2 364 809, to manufacture the casting piston and the casting cylinder as a composite sintered component from a mixture of two or more substances from the substance group which comprises the carbides, borides and nitrides. In particular, a special mixture of boron carbide ($B_4C$) with one or more of $TiB_2$, zirconium diboride ($ZiB_2$) and boron nitride (BN) is specified.

From patent specification U.S. Pat. No. 4,556,098, this and other sintered materials investigated continue to be designated as unsatisfactory, and alternatively a hot-pressed ultrahard silicon nitride or sialon material of high density is proposed for the casting cylinder and casting piston. For a crucible made from cast iron, a protective coating against corrosion and oxidation, composed of Ca, $Al_2O_2$ or other oxides, such as $Al_2O_2$—$TiO_2$, or of $TiB_2$, $ZaB_2$, $CaB_2$ or other pure or mixed borides, or of AlN, $Si_3N_4$, BN, sialons or other nitrides, is specified, which is applied, for example, from an emulsion or by flame spraying. For conical plugs to close access bores for the rising duct and other parts of a casting fitting, manufacture from such likewise corrosion-resistant and erosion-resistant materials is proposed. For parts of the casting mold which are exposed to the metal melt at only lower temperatures, a coating made from a dense material composed of $Si_3N_4$, AlN, sialon, BN, graphite or pyrolytic carbon or alloys thereof is proposed.

It is an object of the invention to provide a casting component of the type initially mentioned and a method for the application of a corrosion layer to a substrate, which may be, in particular, a casting component, the casting component being capable of being produced at relatively low outlay and exhibiting high corrosion resistance for liquid metal casting melts, and, by means of the method, an anticorrosive layer with high corrosion resistance particularly with respect to hot metal melts being capable of being applied comparatively simply and with good layer homogeneity even at locations where access is difficult.

The invention solves this problem by providing a casting component comprising a metallic basic body and a melt contact surface region which is exposed to the metal melt during casting operation, wherein the metallic basic body is provided in the melt contact surface region with an anticorrosive layer which is resistant to the metal melt and which is formed, using at least one of microparticles or nanoparticles of one or more substances from a substance group which comprises borides, nitrides and carbides of the transition metals and their alloys and also boron and silicon and $Al_2O_3$, and by providing an anticorrosive layer application method comprising a sol/gel process, using at least one of microparticles or nanoparticles with an average particle size of between 100 nm and 30 μm as a filler.

In the casting component according to the invention, the metallic basic body is provided, in the melt contact surface region in which it is exposed to the metal melt during casting operation, with an anticorrosive layer which is resistant to the metal melt and which is characteristically formed, using microparticles and/or nanoparticles of one or more substances from a substance group which comprises borides, nitrides and carbides of the transition metals and their alloys and also of boron and silicon and of $Al_2O_3$. Investigations have shown that a casting component equipped with this special anticorrosive layer exhibits unexpectedly good corrosion resistance with respect to contact with hot reactive metal melt, precisely also with respect to aluminum melts. This is assumed to be explained primarily by the presence of one or more anticorrosive substances in the form of microparticles and/or nanoparticles in the layer. In particular, investigations have shown that casting components coated in this way have very high corrosion resistance with respect to aluminum melts and a correspondingly long service life which may be superior to that of identical components which are composed entirely of a steel material or a ceramic material or which are provided conventionally with an anticorrosive layer without microparticles and/or nanoparticles in the layer make-up, even when the same substances are used for the anticorrosive layer.

Owing to the special anticorrosive layer, according to a development of the invention a customary steel material, which is to be understood in the present context also to mean high-grade steel material, can be used for the basic body of the casting component. This makes it possible to produce the component in a simple way, as compared with the use of ceramic materials. Moreover, already existing components having such a basic body made from steel material can easily be provided at a later stage with the anticorrosive layer. At the same time, the mechanical properties of steel which are known to be good are preserved for the casting component.

In a development of the invention, the microparticles and/or nanoparticles possess an average particle size of between 50 nm and 50 μm. In particular, average particle sizes of between 100 nm and 30 μm and especially of between 150 nm and 30 μm prove to be highly advantageous for the anticorrosive layer designed for resistance with respect to hot reactive metal melts.

In a development of the invention, the anticorrosive layer contains at least microparticles and/or nanoparticles composed of $TiB_2$. Anticorrosive layers which are built up on the basis of these $TiB_2$ particles and may optionally contain in addition microparticles and/or nanoparticles of one or more other substances exhibit very high corrosion resistance with respect to corrosion caused by hot Al melts.

In an advantageous development, the anticorrosive layer is a sol/gel layer, that is to say a layer applied by means of a sol/gel process, the microparticles and/or nanoparticles functioning as a filler with which the sol is loaded in the sol/gel process. Such anticorrosive layers can be applied highly uniformly and with homogeneous layer properties even on surface regions of the casting component where access is relatively difficult, this in turn being conducive, overall, to the corrosion resistance and long service life of the casting component.

In a further refinement, the sol/gel anticorrosive layer has a zirconium-based or silicon-based gel former. In a further refinement, the sol/gel anticorrosive layer contains an additionally administered alkali or alkaline earth metal salt and/or an additionally administered viscosity-setting polymer. This makes a supplementary contribution to achieving the desired good layer properties for the anticorrosive layer on corresponding melt contact surface regions of the casting component.

In a further refinement, the sol/gel anticorrosive layer is formed as a multiple layer from a plurality of coating plies, at least two of which are loaded with the microparticles and/or nanoparticles as a filler, and/or at least one layer ply, preferably the last layer ply, is applied without a filler, before all the gel layer plies are then subjected together to a baking process in the sol/gel process. By means of a multiple-ply make-up of this type, the properties of the anticorrosive layer with regard to corrosion resistance to hot metal melts can be further optimized. Thus, for example, a filler-free outer layer ply can function as a covering layer ply composed, for example, of silicon oxide or zirconium oxide. The microparticles and/or nanoparticles then remain embedded in the layer ply or layer plies lying underneath.

In a development of the invention, the casting component is intended for a device for casting an aluminum melt. By virtue of said outstanding corrosion resistance with respect to hot aluminum melts, the casting component according to the invention is eminently suitable for this intended use.

In a development of the invention, the casting component is intended for a metal diecasting machine. In particular, it may be a casting fitting, a casting vessel, a melt furnace constituent, a melt conveying constituent, a casting mold constituent or part of one of these constituents of the metal diecasting machine which come into contact with the melt. Owing to its specific anticorrosive layer, the casting component possesses eminent suitability and a comparatively long service life even for these intended uses.

By means of the method according to the invention, an anticorrosive layer is applied to a substrate by means of a sol/gel process, using microparticles and/or nanoparticles with an average particle size of between 100 nm and 50 μm as a filler. In particular, the substrate may be a casting component according to the invention, to the melt contact surface region of which the anticorrosive layer is applied. Furthermore, however, the substrate may also be any component, the surface of which has to be protected against a corrosive attack of a reactive metal melt.

In a development of the method, a plurality of gel layer plies having microparticles and/or nanoparticles of identical or different substances are formed, before the layer plies are subjected together to a curing and vitrifying baking step.

In a development of the method, a plurality of gel layer plies are formed, a filler-free sol material being used at least for a last layer ply. After a joint vitrifying baking step, the latter forms a filler-free covering layer ply, while the microparticles and/or nanoparticles remain embedded in the inner layer ply or inner layer plies.

In a development of the method, a vitrifying baking process is carried out for one or more gel layer plies at a temperature of between about 500° C. and about 650° C. It is clear that a sol/gel anticorrosion layer formed in this way, when microparticles and/or nanoparticles of suitable substances are used, has very high corrosion resistance with respect to the chemically reactive influence of hot metal melts.

Advantageous embodiments of the invention are illustrated in the drawings and are described below.

DETAILED DESCRIPTION OF THE DRAWINGS

Figure 1:
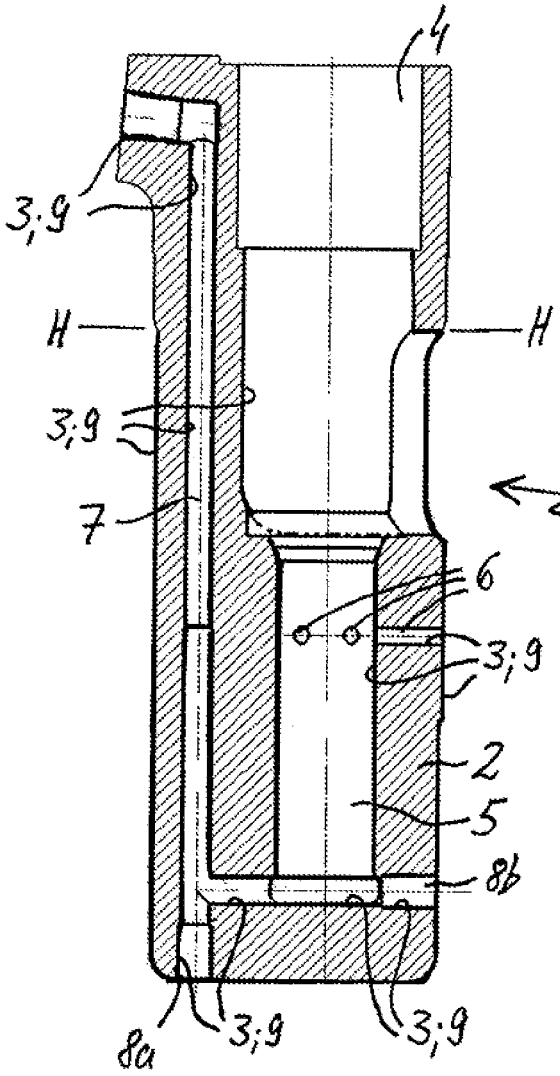
FIG. 1 shows a longitudinal sectional view through a casting vessel with an anticorrosive layer for a hot-chamber diecasting machine.

A casting vessel 1 shown in FIG. 1 is of a type of construction conventional per se, such as is used by the applicant in hot-chamber diecasting machines, for example in order to cast aluminum, magnesium and zinc melts. It possesses a metallic basic body 2 which is preferably composed, as is customary, of a steel material or high-grade steel material and in which various orifices or bores are introduced, in particular a piston rod leadthrough bore 4 which merges at its lower end into a cylindrical melt chamber bore 5, in which an axially movable casting piston is located when the casting piston rod is inserted, inflow bores 6, via which melt is sucked out of a melt furnace or melt crucible into the melt chamber bore 5, a riser duct 7, via which melt is forced out of the melt chamber bore 5 to a casting mold, and access bores 8*a*, 8*b* which serve for introducing the riser duct bore 7 and are closed by means of closure plugs, not shown.

In use, the casting vessel 1 is inserted, in the vertical position shown, into a melt crucible of the melt furnace of the diecasting machine up to a height H marked in FIG. 1. The result of this is that potentially all the inner and outer surfaces of the casting vessel 1 can come into contact up to this height H with the metal melt to be cast. In addition, this melt contact also occurs at the surface of that portion of the riser duct 7 which lies above the height H. All these surface regions which can come into contact with the metallic casting melt during the casting operation are designated in the present case as the melt contact surface regions 9 and are emphasized in FIG. 1 by more thickly drawn lines. In the example shown, these are, in particular, the surfaces of the melt chamber bore 5 and of an adjacent portion of the piston rod leadthrough bore 4 up to at least said height H, of the inflow bores 3, of the riser duct 7, of the access bores 8*a*, 8*b* and of the outside of the basic body 2 up to the height H.

In these melt contact surface regions 9, the basic body 2 of the casting vessel 1 is provided with a characteristic anticorrosion layer 3 which is resistant to the metal melt and which is formed, using microparticles and/or nanoparticles of one or a plurality of selected substances. These substances are selected from a substance group which comprises borides, nitrides and carbides of the transition metals and their alloys and also boron and silicon and aluminum oxide ($Al_2O_3$). The microparticles and/or nanoparticles have an average particle size of between 50 nm and 50 μm, preferably an average particle size of between 100 nm and 30 μm and more preferably of between 150 nm and 30 μm. It proves advantageous to have, inter alia, microparticles and/or nanoparticles composed of $TiB_2$.

In an advantageous embodiment, the anticorrosion layer 3 is applied to the melt contact surface regions 9 as a substrate by means of a sol/gel process, the substrate preferably being a steel material of the casting vessel basic body 2, as stated. The sol/gel anticorrosive layer can in this case be implemented as a single layer or multiple layer.

Figure 2:
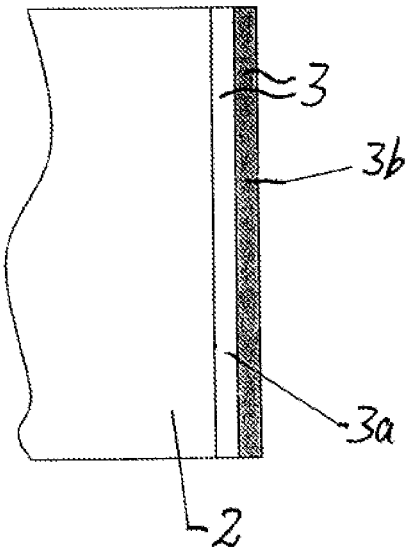
FIG. 2 shows a diagrammatic sectional view of a region of the casting vessel which is provided with the anticorrosive layer.

FIG. 2 illustrates diagrammatically the anticorrosive layer 3 applied to the basic body 2 made, for example, from steel or high-grade steel, being applied in this example as a multiple layer with one or more layer plies, which form an outer filler-free layer part 3*b*, and one or more layer plies forming a layer part 3*a* which is covered by the outer layer part 3*b* and which contains said microparticles and/or nanoparticles as a filler of the sol/gel process. The microparticles and/or nanoparticles are thereby embedded in the inner layer part 3*a* of the anticorrosive layer 3, said inner layer part being covered by the outer layer part as a covering layer ply 3*b*. Typical preferred layer thicknesses for the anticorrosive layer 3 lie in the range between about 1 μm and 500 μm, the selected average particle size of the microparticles and/or nanoparticles being smaller than this in adaptation to the desired layer thickness, so that the microparticles and/or nanoparticles do not protrude on the surface of the anticorrosive layer 3.

Figure 3:
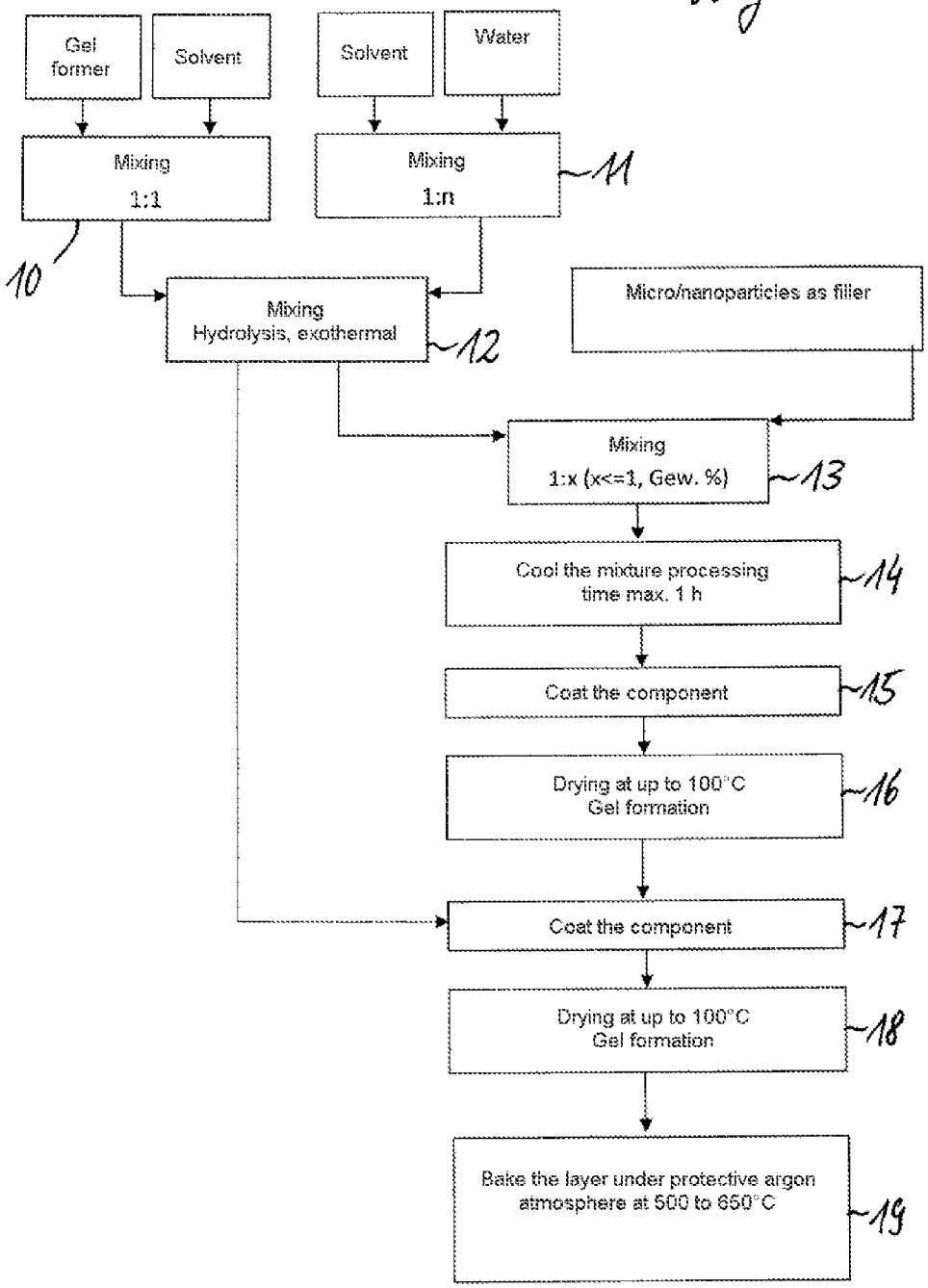
FIG. 3 shows a flowchart to illustrate a method for the application of an anticorrosive layer, for example for the casting vessel of FIG. 1.

FIG. 3 illustrates by way of example a possible advantageous method for the application of an anticorrosive layer by means of a sol/gel process. The anticorrosive layer thereby applied can be the anticorrosive layer 3 of the casting vessel 1 or, alternatively, any other such component which is used in the casting industry or elsewhere and which has a surface which, in use, has to be protected against the reactive influence of a liquid metal melt. As is shown, for this purpose, first, in two separate mixing steps 10, 11, on the one hand, a gel former is mixed with a solvent and, on the other hand, water is mixed with the solvent. The gel former used is a zirconium-based or silicon-based gel former, for example zirconium propoxide, tetramethoxysilane or tetramethylortho-silicate (TMOS), tetraethoxysilane or tetraethylortho-silicate (TEOS), aminopropyltrimethoxysilane (APS(M)) or aminopropyltriethoxysilane (APS(E)). The solvent which can be used is, for example, acetic acid or glacial acetic acid or tetrahydrofuran (THF). Gel formers and solvents are typically mixed in approximately equal parts by weight, and the mix ratio of solvent and water amounts to 1:n mol, n designating the quantity of gel former in mol multiplied by the number of ligands of the gel former.

The two mixtures are subsequently mixed together, thus resulting in exothermal hydrolysis to form the sol as a starting material, see the mixing step 12 in FIG. 3.

For the preparation of sol loaded with filler, in a further mixing step 13 the sol is mixed, that is to say loaded, with the microparticles and/or nanoparticles of one or more of the abovementioned particle substances. As stated, preferred average particle sizes lie in the range of 50 nm to 50 μm and, in particular, between 100 nm and 30 μm or 150 nm and 30 μm. The microparticles and/or nanoparticles are preferably admixed in a proportion by weight which is smaller than or at most equal to the proportion by weight of sol. After a subsequent cooling step, the loaded sol material is ready for use, the processing time typically amounting to at most approximately 1 h. In this time, the component to be coated, such as the casting vessel shown, is coated in the melt contact surface region 3 with a layer ply of the loaded sol material, see step 15 in FIG. 3. The applied layer ply is then dried for gel formation at a suitable temperature of up to approximately 100° C., see step 16.

Steps 15 and 16 for the application of a layer ply composed of prepared sol material and for conversion into a gel layer ply may, if required, be repeated once or more than once in order to produce the sol/gel layer as a multiple layer, in which case, depending on requirements, sol material loaded with microparticles and/or nanoparticles or filler-free sol material without these microparticles and/or nanoparticles can be used for the respective layer ply.

Thus, FIG. 3 shows by way of example the production of a last outer layer ply composed of nonloaded filler-free sol material, as was obtained in mixing step 12. As a result of an appropriate sequence of the coating step 17 and drying step 18, the nonloaded sol is applied and is dried at up to 100° C. for gel formation.

It will be appreciated that, in alternative embodiments, any combinations of layer plies with a nonloaded filler-free sol material and of layer plies with loaded sol material may be implemented, the loaded sol material containing said microparticles and/or nanoparticles of the specified substance group as a filler. It will be appreciated, further, that, depending on requirements, the same loaded layer ply may contain microparticles and/or nanoparticles solely of the same substance or, alternatively, of different substances, and that, depending on requirements, various loaded layer plies may likewise contain microparticles and/or nanoparticles of the same substance or of different substances. It has proved especially suitable, inter alia, to have microparticles and/or nanoparticles composed of $TiB_2$, $Mo_2B_5$, $ZrB_2$ and mixtures of these substances.

After a desired single-ply or multiple-ply layer make-up has been produced from one or more gel layer plies in this way, this layer make-up is cured in a concluding baking step 19 of the sol/gel process and is consequently compressed into a glass-like material. The baking step 19 preferably takes place at a temperature of between 500° C. and 650° C. A protective atmosphere of, for example, argon gas is preferably used for the baking process.

If a nonloaded silicon-based gel former is used for applying the last layer ply according to steps 17 and 18 of FIG. 3, the filler-free covering layer ply 3*b* according to FIG. 2 can be formed from this, for example, as a silicon oxide layer.

It will be appreciated that the invention embraces further embodiments in addition to the exemplary embodiments shown by way of example and explained above. Thus, if required, the casting vessel 1 may also be provided with the anticorrosive layer or another surface layer on further surface regions which do not undergo any melt contact. Further, any other casting components may be provided according to the invention with the anticorrosive layer at least in their melt contact surface region, in particular casting fittings, melt furnace constituents, melt conveying constituents and casting mold constituents or their parts of diecasting machines of the hot-chamber or cold-chamber type and of other devices for casting a metal melt. In the same way, any other components may be provided by means of the method according to the invention with an anticorrosive layer in surface regions which may come into contact with metal melts during use, for example components or appliances, such as are employed for the handling of metal melts during soldering processes, in the production of metal alloys, in the purification of metal melts and when solid metals are recovered from the melt.

It is clear that the special anticorrosive layer has very high corrosion resistance, in particular, even with respect to hot aluminum melts. When the anticorrosive layer is formed by means of a sol/gel process, the layer can be applied at relatively low outlay highly uniformly and homogeneously even in surface regions of the casting component to be coated where access is difficult. If required, an alkali or alkaline earth metal salt and/or a viscosity-setting polymer may additionally be administered to the sol material for the sol/gel layer. In alternative embodiments of the invention, the anticorrosive layer may also be applied by laser build-up welding, flame spraying or plasma spraying.

Further embodiments of the invention comprise the application of a multiple-ply anticorrosive layer, of which at least one, preferably an outer, layer ply is formed by means of the sol/gel application method according to the invention and at least one other layer ply is formed by means of another application method which may be, in particular, laser build-up welding, flame spraying or plasma spraying. As a result, in corresponding applications, a layer make-up adapted optimally to the intended use can be achieved with minimized outlay in production terms. In the same way, according to the invention, any component or substrate may be provided on different surface regions in each case with an anticorrosive layer applied by means of two different application methods of the four mentioned, that is to say the sol/gel method, laser build-up welding, flame spraying and plasma spraying. Thus, for example, the sol/gel process may be used for the coating of regions where access is difficult and one of the other three methods mentioned will be used for the coating of surface regions of the substrate where access is easier. Further, said variants of the "vertical" or "lateral" combination of layers applied by means of different methods may also be combined with one another in the case of appropriate component or substrate.

The invention claimed is:

1. A casting component for a device for casting or handling a metal melt, the component comprising a metallic basic body and a melt contact surface region which is exposed to the metal melt during casting operation, wherein the metallic basic body is provided in the melt contact surface region with an anticorrosive layer which is resistant to the metal melt and which is a sol/gel layer, using, as a filler, at least one of microparticles or nanoparticles of one or more substances selected from the group consisting of borides, nitrides and carbides of the transition metals and their alloys, boron, silicon, and $Al_2O_3$, wherein the sol/gel layer comprises a plurality of gel layer plies, at least one gel layer ply being formed without the microparticles or nanoparticles, and the at least one gel layer ply formed without the microparticles or nanoparticles constitutes the outer layer ply in a depositing direction of the sol/gel layer.

2. The casting component according to claim 1, wherein the microparticles or nanoparticles have an average particle size of between 50 nm and 50 μm.

3. The casting component according to claim 2, wherein the microparticles or nanoparticles have an average particle size of between 100 nm and 30 μm.

4. The casting component according to claim 1, wherein the anticorrosive layer is formed, using microparticles or nanoparticles composed of $TiB_2$.

5. The casting component according to claim 1, wherein the sol/gel layer has a zirconium-based or silicon-based gel former.

6. The casting component according to claim 1, wherein the sol/gel layer contains an additionally administered alkali or alkaline earth metal salt or an additionally administered viscosity-setting polymer.

7. The casting component according to claim 1, wherein at least two of the gel layer plies have microparticles or nanoparticles of identical or different substances.

8. The casting component according to claim 1, wherein the basic body is formed from a steel material.

9. The casting component according to claim 1, wherein the casting component is configured for use in a device for casting an aluminum melt.

10. The casting component according to claim 1, wherein the casting component is configured for use in a metal diecasting machine.

11. A casting component for a device for casting or handling a metal melt, the component comprising a metallic basic body and a melt contact surface region which is exposed to the metal melt during casting operation, wherein the metallic basic body is provided in the melt contact surface region with an anticorrosive layer which is resistant to the metal melt and which is a sol/gel layer, using, as a filler, at least one of microparticles or nanoparticles of one or more substances selected from the group consisting of borides, nitrides and carbides of the transition metals and their alloys, boron, silicon, and $Al_2O_3$, wherein the sol/gel layer comprises a plurality of gel layer plies, at least one gel layer ply being formed without the microparticles or nanoparticles, and the at least one gel layer ply formed without the microparticles or nanoparticles constitutes the outer layer ply in a depositing direction of the sol/gel layer, and wherein the casting component is configured for use as a casting fitting, a casting vessel, a melt furnace constituent, a melt conveying constituent, or a part of one of these diecasting machine constituents.

12. The casting component according to claim 11, wherein the microparticles or nanoparticles have an average particle size of between 50 nm and 50 μm.

13. The casting component according to claim 12, wherein the microparticles or nanoparticles have an average particle size of between 100 nm and 30 μm.

14. The casting component according to claim 11, wherein the anticorrosive layer is formed, using microparticles or nanoparticles composed of $TiB_2$.

15. The casting component according to claim 11, wherein the sol/gel layer has a zirconium-based or silicon-based gel former.

16. The casting component according to claim 11, wherein the sol/gel layer contains an additionally administered alkali or alkaline earth metal salt or an additionally administered viscosity-setting polymer.

17. The casting component according to claim 11, wherein at least two of the gel layer plies have microparticles or nanoparticles of identical or different substances.

18. The casting component according to claim 11, wherein the basic body is formed from a steel material.

19. The casting component according to claim 11, wherein the casting component is configured for use in a device for casting an aluminum melt.

20. The casting component according to claim 11, wherein the casting component is configured for use in a metal diecasting machine.

* * * * *